US007902473B2

(12) United States Patent
Yeh

(10) Patent No.: US 7,902,473 B2
(45) Date of Patent: Mar. 8, 2011

(54) KEY SWITCH WITH EXHAUST STRUCTURE

(75) Inventor: Liang-Ta Yeh, Shulin (TW)

(73) Assignee: Darfon Electronics Incorporated, Taoyuan (TW)

( * ) Notice: Subject to any disclaimer, the term of this patent is extended or adjusted under 35 U.S.C. 154(b) by 630 days.

(21) Appl. No.: 11/984,728

(22) Filed: Nov. 21, 2007

(65) Prior Publication Data

US 2008/0121509 A1 May 29, 2008

(30) Foreign Application Priority Data

Nov. 23, 2006 (TW) ..... 95220661 U

(51) Int. Cl.
*H01H 13/70* (2006.01)

(52) U.S. Cl. ..... 200/515; 200/341; 200/344

(58) Field of Classification Search ..... 200/512–517, 200/302.1, 302.2, 5 A; 400/490, 491, 491.1, 400/491.2, 495, 495.1, 496
See application file for complete search history.

(56) References Cited

U.S. PATENT DOCUMENTS 6,664,901 B1 * 12/2003 Yamada et al. ..... 200/302.1

* cited by examiner

*Primary Examiner* — Renee Luebke

*Assistant Examiner* — Marina Fishman

(74) *Attorney, Agent, or Firm* — Stites & Harbison PLLC; Juan Carlos A. Marquez, Esq.

(57) ABSTRACT

The present invention provides a key switch with an exhaust structure, which includes a keycap having a top surface and an inner surface with a cavity and an elastic member. The elastic member includes a protrusion and an elastic body. The protrusion is coupled with the inner surface of the keycap. A gas channel is formed between the cavity of the keycap and the protrusion of the elastic member. When an external force is applied to the top surface of the keycap to compress the elastic body, the gas within the elastic member can be exhausted through the gas channel of the elastic member.

18 Claims, 6 Drawing Sheets

KEY SWITCH WITH EXHAUST STRUCTURE

CROSS REFERENCE TO RELATED APPLICATIONS

This application claims the right of priority based on Taiwan Patent Application No. 95220661 entitled "Key with Exhaust Structure," filed on Nov. 23, 2006, which is incorporated herein by reference and assigned to the assignee herein.

FIELD OF THE INVENTION

This invention relates to a key switch with an exhaust structure, and more particularly, relates to a key switch with an exhaust structure which is coupled with an elastic member having a gas channel, so that when an external force is applied to the keycap to compress the elastic member, the gas within the elastic member is exhausted through the gas channel or the exhaust structure.

BACKGROUND OF THE INVENTION

Following the fast development of high technology, computers have become more and more important in our daily life. Therefore, using a keyboard for data entry has become a part of routine works in our daily life. When users press the key switch, the keycap is closely attached to the rubber dome and the gas within the rubber dome is exhausted. However, a vacuum may be produced within the key switch, and in turn, the movement of the key switch will be affected. Thus, it is desired to provide a key switch with an exhaust structure so that the gas within the keyboard can exhaust freely and the formation of the vacuum can be effectively eliminated during the operation of the keyboard.

SUMMARY OF THE INVENTION

One object of the present invention is to provide a key switch, which includes a keycap having an inner surface with a cavity. The cavity can be a gas channel for exhausting gas within an elastic member when the elastic member is coupled with the inner surface of the keycap.

Another object of the present invention is to provide a key switch including an elastic member having a protrusion with at least one notch at its top end. When the protrusion is coupled with the inner surface of the keycap, a gas channel can be formed, and therefore, when an external force is applied to the keycap to compress the elastic member, the gas within the elastic member can be exhausted through the notch.

Still another object of the present invention is to provide a key switch including an elastic member having a protrusion with at least one aperture in its sidewall serving as a gas channel. When a keycap is coupled with the elastic member and an external force is applied to the keycap to compress the elastic member, the gas within the elastic member can be exhausted through the aperture.

In one preferable embodiment, the present invention provides a key switch with an exhaust structure. The key switch includes a keycap having a top surface and an inner surface; and an elastic member having a protrusion and an elastic body, a top end of the protrusion having at least one notch, the protrusion being coupled with the inner surface of the keycap, so that a gas channel is formed between the keycap and the elastic member. When an external force is applied to the top surface of the keycap to compress the elastic body, the gas within the elastic member is exhausted through the gas channel.

DETAILED DESCRIPTION OF THE INVENTION

The preferable embodiments of the present invention are discussed in detail hereinafter. However, it is understood that the invention can have variations and modifications in other embodiments without departing from the scope, and the invention is not to be limited to the details given herein.

FIG. 1A to FIG. 1F are schematic views of various keycaps, which may or may not have a cavity of different shape. FIG. 2A to FIG. 2C are schematic views of various elastic members, which may or may not have a notch and/or an aperture. FIG. 3A, FIG. 3B, FIG. 4A, FIG. 4B, FIG. 5A and FIG. 5B are schematic views of various embodiments showing an elastic member coupled with a keycap.

Figure 1A:
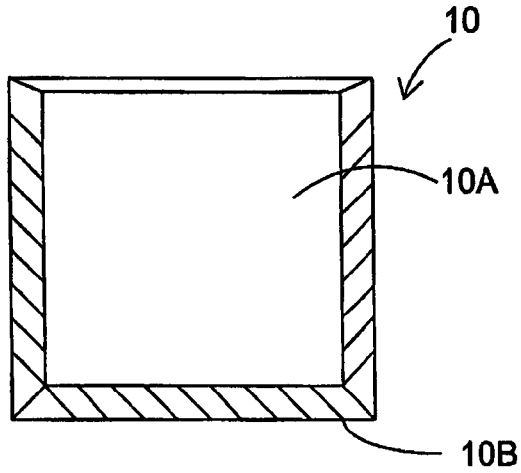
FIG. 1A is a top view of the keycap in accordance with one embodiment of the present invention.
Figure 2A:
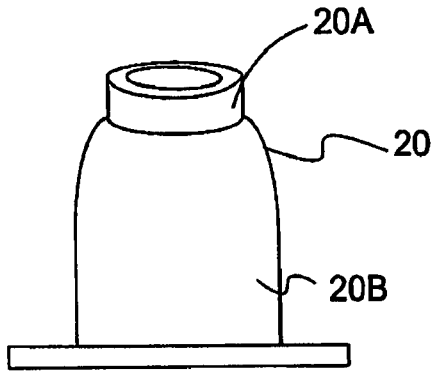
FIG. 2A is a side view of an elastic member in accordance with an embodiment of the present invention.
Figure 2B:
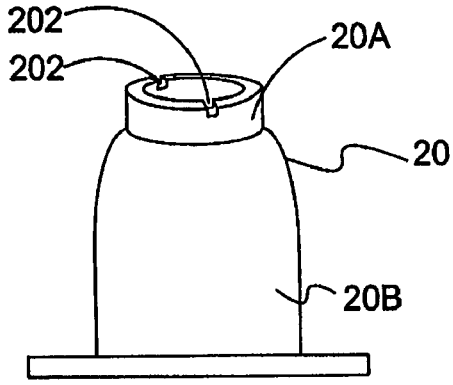
FIG. 2B is a side view of an elastic member having gas channels in accordance with another embodiment of the present invention.
Figure 2C:
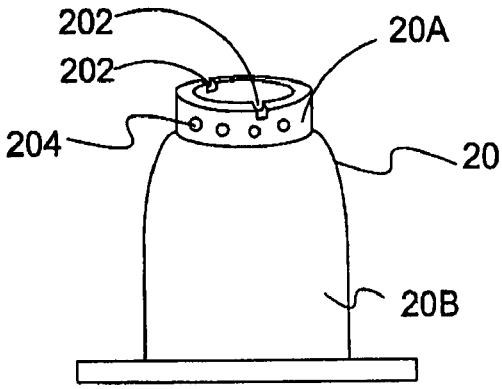
FIG. 2C is a side view of an protrusion of the elastic member having at least one notch and at least one aperture in its top end and sidewall in accordance with a modified embodiment of the present invention.

Referring to FIG. 1A, a top view of a keycap for a keyboard that is often used in the desktop computer or the portable computer is illustrated. As shown in FIG. 1A, the reference number 10A refers to the top surface of the keycap 10, and the reference number 10B refers to the inner surface of the keycap 10.

Figure 1B:
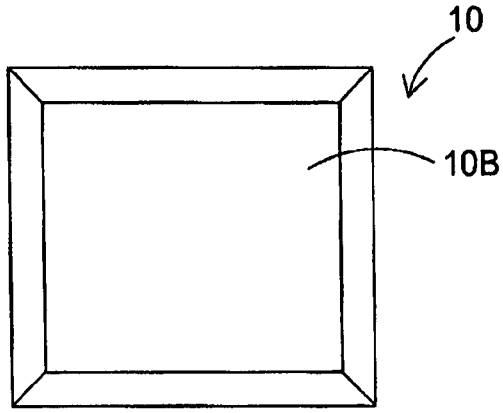
FIG. 1B is a bottom view of the keycap in accordance with one embodiment of the present invention.

FIG. 1B is a schematic view of the inner surface 10B of the keycap 10, and shows that no cavity is formed in the inner surface 10B of the keycap 10.

Referring now to FIG. 1C to FIG. 1F, the cavity of different shape is formed in the inner surface 10B of the keycap 10 according to different embodiment, respectively. According to embodiments of the present invention, the cavity 101 located in the inner surface 10B of the keycap 10 is designed for forming a gas channel between the keycap 10 and the elastic member 20 when the inner surface 10B is coupled with the protrusion 20A of the elastic member 20.

Figure 1C:
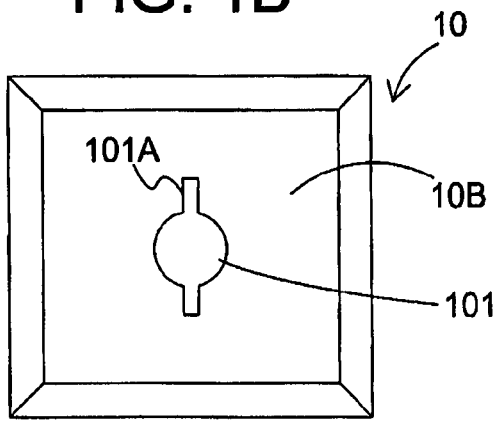
FIG. 1C is a schematic illustration of an inner surface with a cavity having a circular shape with an extended groove of the keycap in accordance with another embodiment of the present invention.
Figure 1D:
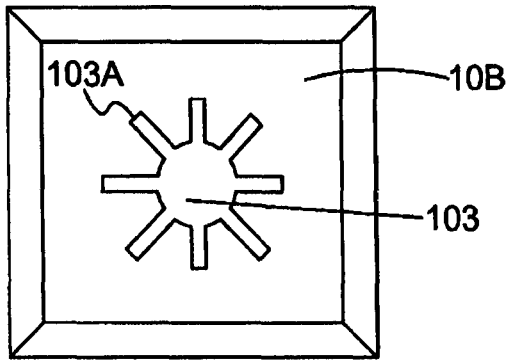
FIG. 1D is a schematic illustration of an inner surface with a cavity having an radiant shape of the keycap in accordance with another embodiment of the present invention.
Figure 1E:
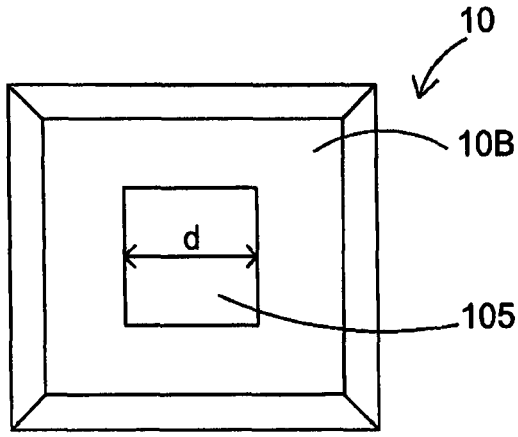
FIG. 1E is a schematic illustration of an inner surface with a cavity having a rectangular shape of the keycap in accordance with another embodiment of the present invention.
Figure 1F:
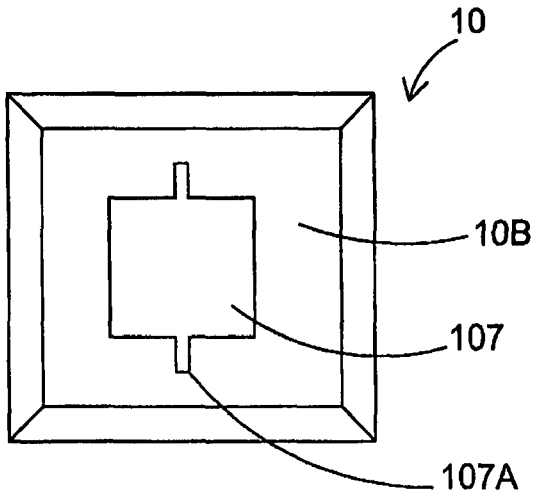
FIG. 1F is a schematic illustration of an inner surface with a cavity having a rectangular shape with at least two extended grooves of the keycap in accordance with a modified embodiment of the present invention.

For example, in one embodiment, the cavity 101 has a circular shape with at least two extended grooves 101A (as shown in FIG. 1C). In another embodiment, the cavity 103 has a circular shape with extended grooves 103A arranged in a radiant shape (as shown in FIG. 1D). In other embodiments, the cavity 105 has a rectangular shape (as shown in FIG. 1E), or the cavity 107 has a rectangular shape with at least two extended grooves 107A (as shown in FIG. 1F). The width (or the diameter) of the cavities 101, 103, 105, 107 is preferably smaller than the diameter of the protrusion of the elastic member 20. In the exemplary embodiment, the depths of the cavities 101, 103, 105, 107 and the extended grooves 101A, 103A, 107A are about 0.1 to 0.2 millimeter, as shown in FIG. 1C to 1F. It should be understood that the shape of the cavities or the number of the extended grooves are not limited to the embodiments described above.

FIG. 2A to FIG. 2C shows the side views of an elastic member without any notch (FIG. 2A) and elastic members with notches and/or apertures (FIGS. 2B and 2C), respectively. As shown in FIG. 2A, the elastic member 20 includes a protrusion 20A disposed on an elastic body 20B. The protrusion 20A is arranged as a ring structure protruded from the elastic body 20B, and no notch or aperture is formed in the protrusion 20A.

Referring to FIG. 2B, a top view of an elastic member with notches is shown. As shown in FIG. 2B, the top end of the protrusion 20A of the elastic member 20 has two notches 202, which serves as a gas channel. Please note that the notch 202 may be disposed in any places of the top end of the protrusion 20A to allow gas to flow through the notch 202 to/from the external environment.

Moreover, referring to FIG. 2C, a top view of the elastic member with notches and apertures is illustrated. As shown in FIG. 2C, the top end of the protrusion 20A of the elastic member 20 has at least one notch 202, and the sidewall of the protrusion 20A of the elastic member 20 has at least one aperture 204. As discussed above, the aperture 204 may also function as a gas channel so as to further facilitate the gas exhaust.

Figure 3A:
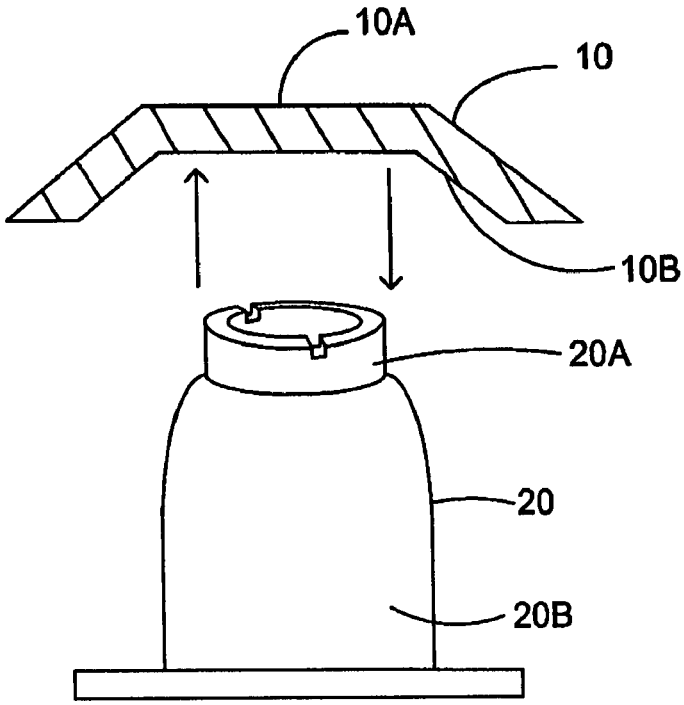
FIG. 3A and FIG. 3B show schematic views of the keycap without the cavity coupled with the elastic member with the notches in accordance with an embodiment of the present invention.
Figure 3B:
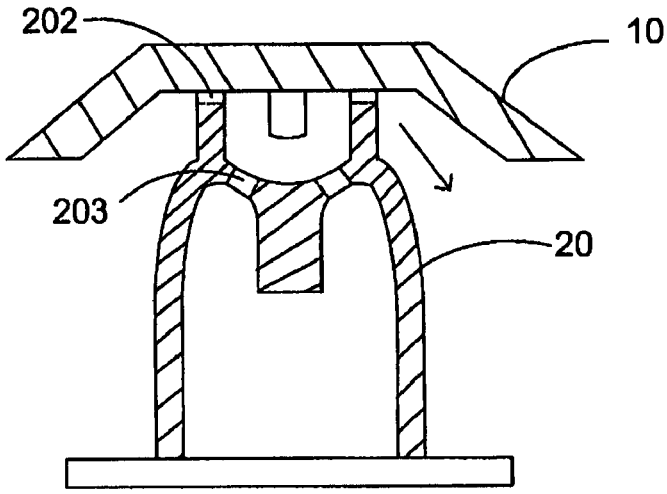

Referring to FIG. 3A to FIG. 3B, FIG. 4A to FIG. 4B, and FIG. 5A to FIG. 5B, three embodiments of the present invention are disclosed. In one embodiment, as shown in FIG. 3A and FIG. 3B, the keycap 10 of FIG. 1B and the elastic member 20 of FIG. 2B are coupled. For example, when the inner surface 10B of the keycap 10 is coupled with the protrusion 20A of the elastic member 20, with the design of the protrusion 20A having notches 202 on its top end, a gas channel can be formed between the keycap 10 and the elastic member 20. Then, referring to FIG. 3B, when an external force is applied to the top surface 10A of the keycap 10 to compress the elastic body 20A, the gas within the elastic member 20 can be exhausted through the gas channel (i.e. the notch 202 located at the top end of the protrusion 20A of the elastic member 20) to maintain a good typing "feel". Furthermore, a second gas channel 203 is formed at an interface of the protrusion 20A and the elastic body 20B of the elastic member 20, so that gas can flow from/to the elastic body 20B through the protrusion 20A. For example, a though hole 203 is formed in the interface of the protrusion 20A and the elastic body 20B, so that the spaces defined by the elastic body 20B and the protrusion 20A can be communicated. When an external force is applied to the key cap 10, the elastic body 20B is deformed, and the through hole 203 serving as the second gas channel allows the gas within the elastic body 20B to flow to the space defined by the protrusion 20A then exhausted through the notches 202.

Figure 4A:
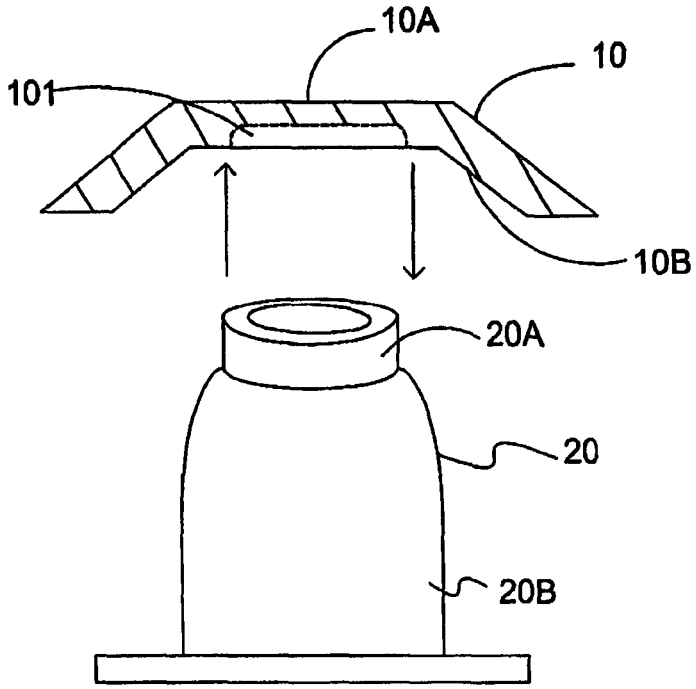
FIG. 4A and FIG. 4B show schematic views of the keycap with a cavity coupled with the elastic member without the notch in accordance with another embodiment of the present invention.
Figure 4B:
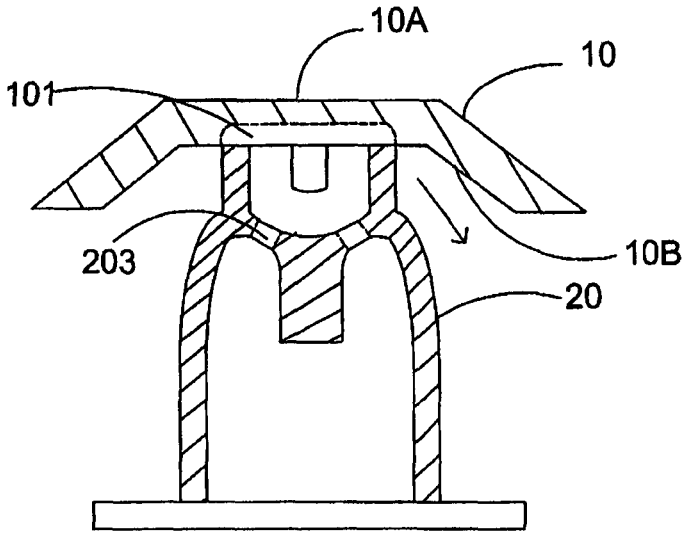

Referring now to FIGS. 4A and 4B, in another embodiment, a keycap having an inner surface with a cavity and an elastic member without notches are disclosed. As shown in FIG. 4A, a keycap 10 with a cavity shown in one of FIGS. 1C, 1D, and 1F is coupled with the top end of the protrusion 20A of the elastic member 20. Please note that in this embodiment, the keycap 10 of FIG. 1C is illustrated for description. As shown in FIG. 4B, when the inner surface 10A of the keycap 10 is coupled with the protrusion 20A of the elastic member 20, a gas channel can be formed between the keycap 10 and the elastic member 20 due to the cavity 101. Therefore, when an external force is applied to the top surface 10A of the keycap 10 to compress the elastic body 20B, the gas within the elastic member 20 is exhausted through the gas channel. Similarly, a second gas channel 203 can be formed at the interface of the protrusion 20A and the elastic body 20B, so as to further facilitate the gas exhaust.

It is noted, in this embodiment, the inner diameter of the cavity 101, 103, 107 is preferably slightly smaller than the outer diameter of the protrusion 20A of the elastic member 20, so that when the protrusion 20A of the elastic member 20 is coupled with the keycap 10, the protrusion 20A touches against the inner surface 10B of the keycap 10 to form a gas channel. For example, since the outer diameter of the protrusion 20A is slightly larger than the inner diameter of the cavity 101, 103, 107 of the keycap 10, the top end of the protrusion 20A does not directly touch against the surface defined within the cavity, in turn, does not block the path between the extended grooves 101A, 103A, 107A to the cavity 101, 103, 107. Furthermore, the outer diameter of the protrusion 20A is preferably not larger enough to completely cover the cavity 101, 103, 105 with extended grooves 101A, 103A, 107A. Therefore, when the protrusion 20A is coupled with the keycap 10, the cavity 101, 103, 107 with extended grooves 101A, 103A, 107A can function as a gas channel for exhausting the gas from the elastic member 20. Similarly, a second channel 203 can be formed at the interface of the protrusion 20A and the elastic body 20B as described.

In another embodiment, when the keycap 10 of FIG. 1E is implemented with the protrusion having no notch on its top end, such as the protrusion 20A of FIG. 2A, by manipulating the diameters of the protrusion and the cavity incorporation with the consideration of the difference in shape, such as circular and rectangular, a portion of the cavity not covered by the protrusion can function as a gas channel for exhausting the gas from the elastic member.

Figure 5A:
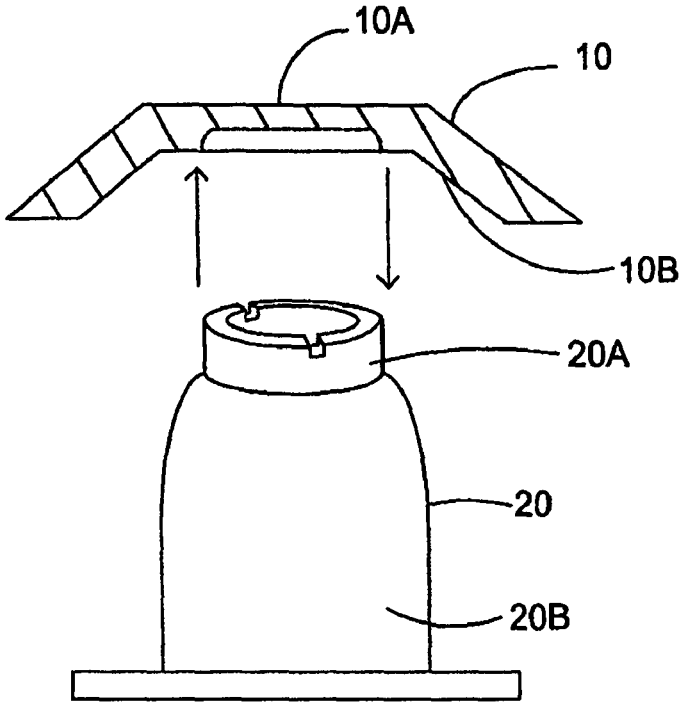
FIG. 5A and FIG. 5B show schematic views of the keycap with a cavity coupled with the elastic member with the notches in accordance with another embodiment of the present invention.
Figure 5B:
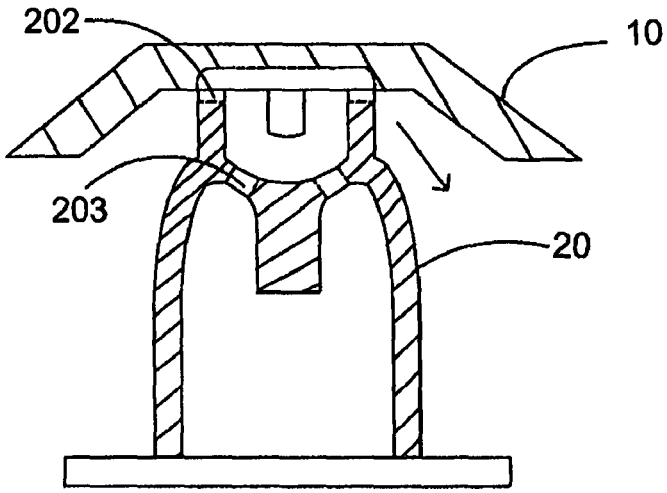

FIG. 5A and FIG. 5B show a keycap 10 with an inner surface 10B having a cavity and an elastic member 20 with a protrusion 20A having a notch 202 at the top end of the protrusion 20A according to another embodiment of the present invention. The inner surface 10B of the keycap 10 has a cavity 101 with an extended groove (not shown), and the top end of the protrusion 20A of the elastic member 20 has at least one notch 202. As shown FIG. 5B, the inner surface 10B of the keycap 10 is coupled with the protrusion 20A of the elastic member 20, so that a first gas channel is formed between the protrusion 20A and the keycap 10 as described above. Please note that the notch 202 at the top end of the protrusion 20A may or may not be aligned with the extended groove of the inner surface 10B of the keycap 10. Thus, when an external force is applied to the top surface 10A of the keycap 10 to compress the elastic body 20B, the gas within the elastic member 20 may flow from the elastic body via the through hole 203 to the protrusion, and then be exhausted through the notch 202, the extended groove 101A, 103A, 107A, the cavity 101, 103, 105, 107 and/or the apertures 204 to effect the gas exhaust. In this embodiment, because the protrusion 20A of FIG. 2C has apertures 204 in its sidewall, the keycap 10 coupled with the protrusion 20A of FIG. 2C may or may not have a cavity, and a key switch with an exhaust structure (the apertures 204) still can be formed. Thus, when an external force is applied to the keycap 10 to compress the elastic member 20, the gas within the elastic member 20 may be exhausted through the apertures 204 to maintain a good typing "feel".

Although specific embodiments have been illustrated and described, it will be obvious to those skilled in the art that various modifications may be made without departing from what is intended to be limited solely by the appended claims.

The invention claimed is:

1. A key switch with an exhaust structure, comprising:

a keycap having a top surface and an inner surface with a cavity; and an elastic member having a protrusion and an elastic body, said protrusion being coupled with said inner surface of said keycap, so that a first gas channel is formed between said cavity of said keycap and said protrusion of said elastic member, wherein when an external force is applied to said top surface of said keycap to compress said elastic body, the gas within said elastic member is exhausted through said first gas channel; and wherein a vertical sidewall of said protrusion of said elastic member has at least one aperture, and the at least one aperture is away from a top end of the vertical sidewall of said protrusion of said elastic member.

2. The key switch of claim 1, wherein a second gas channel is formed at a junction surface of said protrusion and said elastic body, so that gas can flow from/to said elastic body through said protrusion.

3. The key switch of claim 1, wherein the depth of said cavity is about 0.1 millimeter to 0.2 millimeter.

4. The key switch of claim 1, wherein said cavity has a rectangular shape, or a rectangular shape with at least one extended groove.

5. The key switch of claim 1, wherein said cavity has a circular shape with at least one extended groove.

6. The key switch of claim 1, wherein said cavity has a geometric shape.

7. The key switch of claim 1, wherein the top end of said protrusion has at least one notch.

8. The key switch of claim 1, wherein the at least one aperture is not through the top end of the vertical sidewall.

9. A key switch with an exhaust structure, comprising:

a keycap having a top surface and an inner surface; and an elastic member having a protrusion and an elastic body, a top end of a vertical sidewall of said protrusion having at least one notch, said protrusion of said elastic member touching against said inner surface of said keycap so that a first gas channel is formed between said keycap and said elastic member, wherein when an external force is applied to said top surface of said keycap to compress said elastic body, the gas within said elastic member is exhausted through said first gas channel; and wherein the vertical sidewall of said protrusion of said elastic member has at least one aperture, and the at least one aperture is away from the top end of the vertical sidewall of said protrusion of said elastic member.

10. The key switch of claim 9, wherein a second gas channel is formed at a junction surface of said protrusion and said elastic body, so that gas can flow from/to said elastic body through said protrusion.

11. The key switch of claim 9, wherein the depth of said cavity is about 0.1 millimeter to 0.2 millimeter.

12. The key switch of claim 9, wherein the at least one aperture is not through the top end of the vertical sidewall.

13. A key switch with an exhaust structure, comprising:

a keycap having a top surface and an inner surface with a cavity; and an elastic member having a protrusion and an elastic body, a top end of a vertical sidewall of said protrusion having at least one notch, said protrusion being coupled with said inner surface of said keycap so that a first gas channel is formed between said keycap and said protrusion, wherein when an external force is applied to said top surface of said keycap to compress said elastic body, the gas within said elastic member is exhausted through said first gas channel; and wherein the vertical sidewall of said protrusion of said elastic member has at least one aperture, and the at least one aperture is away from the top end of the vertical sidewall of said protrusion of said elastic member.

14. The key switch of claim 13, wherein the depth of said cavity is about 0.1 millimeter to 0.2 millimeter.

15. The key switch of claim 13, wherein said cavity has a rectangular shape or a rectangular shape with at least one extended groove.

16. The key switch of claim 13, wherein said cavity has a circular shape with at least one extended groove.

17. The key switch of claim 13, wherein said cavity has a geometric shape.

18. The key switch of claim 13, wherein the at least one aperture is not through the top end of the vertical sidewall.

* * * * *